US007511426B2

(12) United States Patent
Eden et al.

(10) Patent No.: US 7,511,426 B2
(45) Date of Patent: Mar. 31, 2009

(54) MICROPLASMA DEVICES EXCITED BY INTERDIGITATED ELECTRODES

(75) Inventors: J. Gary Eden, Mahomet, IL (US); Sung-O Kim, Hsinchu (TW)

(73) Assignee: The Board of Trustees of the University of Illinois, Urbana, IL (US)

( * ) Notice: Subject to any disclaimer, the term of this patent is extended or adjusted under 35 U.S.C. 154(b) by 266 days.

(21) Appl. No.: 10/984,022

(22) Filed: Nov. 8, 2004

(65) Prior Publication Data

US 2006/0038490 A1 Feb. 23, 2006

Related U.S. Application Data

(63) Continuation-in-part of application No. 10/829,666, filed on Apr. 22, 2004, now Pat. No. 7,372,202.

(51) Int. Cl.
*H01J 17/49* (2006.01)

(52) U.S. Cl. ..... 313/582; 313/586; 313/587; 313/493

(58) Field of Classification Search ..... 313/582–587, 313/491, 493

See application file for complete search history.

(56) References Cited

U.S. PATENT DOCUMENTS 3,487,254 A 12/1969 Vollmer
3,697,797 A 10/1972 Freyheit et al.
3,793,552 A 2/1974 Glascock et al.
3,908,147 A 9/1975 Hall et al.
3,970,887 A 7/1976 Smith et al.
4,060,748 A 11/1977 Bayless
4,370,797 A 2/1983 van Gorkom et al.
4,459,636 A 7/1984 Meister et al.
4,638,218 A * 1/1987 Shinoda et al. ..... 315/169.4
4,672,624 A 6/1987 Ford
4,698,546 A 10/1987 Maitland et al.
4,728,864 A * 3/1988 Dick ..... 315/169.3
4,808,883 A 2/1989 Iwaya et al.
4,843,281 A * 6/1989 Mendelsohn ..... 313/587
4,890,031 A 12/1989 Zwier (Continued)

FOREIGN PATENT DOCUMENTS

JP 7192701 7/1995

OTHER PUBLICATIONS

A.. El-Habachi, et al., Sep. 15, 2000, "Series operation of direct current xenon chloride excimer sources," Journal of Applied Physics, vol. 88, No. 6, pp. 3220-3224.

(Continued)

*Primary Examiner*—Karabi Guharay
(74) *Attorney, Agent, or Firm*—Greer, Burns & Crain, Ltd.

(57) ABSTRACT

A preferred embodiment microplasma device includes first and second substrates. An electrode array is disposed on the first substrate. Cavities are formed in the second substrate by laser micromachining, etching, or by chemical (wet or dry) etching and the second substrate is overlaid on the electrode array. The inter-electrode spacing and electrode width are set so that each cavity has at least one pair of electrodes underneath it to excite a microplasma discharge in the cavity. A need to precisely register the two substrates is avoided.

14 Claims, 2 Drawing Sheets

U.S. PATENT DOCUMENTS

| | | | | |
|---|---|---|---|---|
| 4,988,918 | A | 1/1991 | Mori et al. | |
| 4,992,703 | A | 2/1991 | Ramaiah | |
| 5,013,902 | A | 5/1991 | Allard | |
| 5,055,979 | A | 10/1991 | Boland et al. | |
| 5,062,116 | A | 10/1991 | Christensen | |
| 5,164,633 | A * | 11/1992 | Kim et al. | 313/581 |
| 5,200,973 | A | 4/1993 | Ford | |
| 5,387,805 | A | 2/1995 | Metzler et al. | |
| 5,438,343 | A | 8/1995 | Khan et al. | |
| 5,496,199 | A | 3/1996 | Makishima et al. | |
| 5,514,847 | A | 5/1996 | Makishima et al. | |
| 5,626,772 | A * | 5/1997 | Bongaerts et al. | 216/24 |
| 5,686,789 | A | 11/1997 | Schoenbach et al. | |
| 5,723,945 | A * | 3/1998 | Schermerhorn | 313/581 |
| 5,926,496 | A | 7/1999 | Ho et al. | |
| 5,939,829 | A | 8/1999 | Schoenbach et al. | |
| 5,990,620 | A | 11/1999 | Lepselter | |
| 6,016,027 | A | 1/2000 | DeTemple et al. | |
| 6,082,294 | A | 7/2000 | Simpson | |
| 6,139,384 | A | 10/2000 | DeTemple et al. | |
| 6,194,833 | B1 | 2/2001 | DeTemple et al. | |
| 6,346,770 | B1 | 2/2002 | Schoenbach et al. | |
| 6,353,289 | B1 | 3/2002 | Ishigami et al. | |
| 6,433,480 | B1 | 8/2002 | Stark et al. | |
| 6,459,201 | B1 * | 10/2002 | Schermerhorn et al. | 313/586 |
| 6,541,915 | B2 | 4/2003 | Eden et al. | |
| 6,548,962 | B1 * | 4/2003 | Shiokawa et al. | 315/169.4 |
| 6,563,257 | B2 | 5/2003 | Vojak et al. | |
| 6,597,120 | B1 * | 7/2003 | Schemerhorn et al. | 315/169.3 |
| 6,695,664 | B2 | 2/2004 | Eden et al. | |
| 6,815,891 | B2 | 11/2004 | Eden et al. | |
| 6,825,606 | B2 * | 11/2004 | Schermerhorn et al. | 313/484 |
| 6,828,730 | B2 | 12/2004 | Eden et al. | |
| 6,867,548 | B2 | 3/2005 | Eden et al. | |
| 2006/0084262 | A1 | 4/2006 | Qin | |

OTHER PUBLICATIONS

K. H. Schoenbach , et al, Jan. 1996., "Microhollow cathode discharges," Appl. Phys. Lett., vol. 68, No. 1, pp. 13-15.

L. D. Biborosch, et al, Dec. 20, 1999, "Microdischarges with plane cathodes," Appl. Phys. Lett., vol. 75, No. 25, pp. 3926-3928.

S. J. Park, et al, Jul. 10, 2000, "Flexible microdischarge arrays: Metal/polymer devices", Applied Physics Letters, vol. 77, No. 2, pp. 199-201.

J.W. Frame et al., Sep. 1997, "Microdischarge devices fabricated in silicon", Applied Physics Letters, vol. 71, No. 9, pp. 1165-1167.

J.W. Frame,et al., May 25, 1998, "Continuous-wave emission in the ultraviolet from diatomic excimers in a microdischarge", Applied Physics Letters, vol. 72, No. 21, pp. 2634-2636.

J.W. Frame et al., Jul. 23, 1998, "Planar microdischarge arrays", Electronics Letters, vol. 34, No. 15, pp. 1529-1531.

Karl H. Schoenbach et al, Jun. 30, 1997, "High-pressure hollow cathode discharges;"; Plasma Sources Sci Technical., pp. 468-477.

A. El-Habachi, et al, Jan. 5, 1998, "Emission of excimer radiation from direct current, high-pressure hollow cathode discharges;"; App. Phys. Lett. 72 (1), pp. 22-24.

S. J. Park et al., Jan. 2001, "Performance of microdischarge devices and arrays with screen electrodes," IEEE Photon, Tech. Lett., vol. 13, pp. 61-63.

C. J. Wagner, et al., Feb. 12, 2001, "Excitation of a microdischarge with a reverse-biased pn junction," Appl. Phys. Lett., vol. 78, pp. 709-711.

S. J. Park et al., Sep. 24, 2001, "Independently addressable subarrays of silicon microdischarge devices: Electrical characteristics of large (30×30) arrays and excitation of a phosphor," Appl. Phys. Lett., vol. 79, pp. 2100-2102.

B.A.Voyak, et al., Mar. 5, 2001, "Multistage, monolithic ceramic microdischarge device having an active length of -0.27 mm," Appl. Phys. Lett., vol. 78, No. 10, pp. 1340-1342.

R. H. Stark et. al., Feb. 15, 1999, "Direct current high-pressure glow discharges", J. Appl. Phys. vol. 85, pp. 2075-2080.

J.F. Waymouth, Dec. 1991, "LTE and Near-LTE Lighting Plasmas", IEEE Transaction on Plasma Science, Vo. 19 No. 6 pp. 1003-1012.

A.D. White, May 1959, "New Hollow Cathode Glow Discharge", Journal of Applied Physics, vol. 30, No. 5, pp. 711-719.

L.C. Pitchford, et al., Jul. 1997, "The breakdown and glow phases during the initiation of discharges for lamps", J. Appl. Phys. 82, (1) pp. 112-119.

S. J.Park et al., Feb. 1, 2001, "Arrays of microdischarge devices having 50-100um square pyramidal Si anodes and screen cathodes," 1 Electron. Lett. . vol. 37 No. 3, pp. 171-172.

J.G. Eden et al., Nov. 2003, "Microplasma devices fabricated in silicon, ceramic, and metal/polymer structures: arrays, emitters and photodetectors," Journal of Physics *D: Applied Physics* 36, p. 2869-2877.

S. J. Park et al., May 31, 2004, "Carbon nanotube-enhanced performance of microplasma devices," Applied Physics Letters, pp. 4481-4483, vol. 84, No. 22.

H. Masuda; et al., Jun. 9, 1995, "Ordered Metal Nanohole Arrays Made by a Two-Step Replication of Honeycomb Structures of Anodic Alumina", Science, New Series, vol. 268, No. 5216, 1466-1468.

O. Jessensky et al., Mar. 9, 1998, "Self-organized formation of hexagonal pore arrays in anodic alumina", Applied Physics Letters, vol. 72 No. 10., 1173-1175.

R. H. Stark et al., Jun. 21, 1999, "Direct current glow discharges in atmospheric air," Appl. Phys. Lett., vol. 74, pp. 3770-3772.

S.-J. Park et al., Jan. 22, 2001, "Silicon microdischarge devices having inverted pyramidal cathodes: Fabrication and performance of arrays," Appl. Phys. Lett., vol. 78, pp. 419-421.

A.-A. H. Mohamed, et al., Feb. 2002, "Direct current glow discharges in atmospheric air," IEEE Trans. Plasma Sci., vol. 30, pp. 182-183.

* cited by examiner

MICROPLASMA DEVICES EXCITED BY INTERDIGITATED ELECTRODES

CROSS REFERENCE TO RELATED APPLICATIONS

This application is a continuation-in-part of U.S. patent application Ser. No. 10/829,666, filed Apr. 22, 2004 now U.S. Pat. No. 7,372,202, entitled "Phase Locked Microdischarge Array and AC, RF, or Pulse Excited Microdischarge," which is incorporated herein by reference.

STATEMENT OF GOVERNMENT INTEREST

This invention was made with Government assistance under U.S. Air Force Office of Scientific Research grant No. F49620-00-1-0391. The Government has certain rights in this invention.

TECHNICAL FIELD

The present invention relates to microplasma devices and arrays of such devices and, in particular, to methods for fabricating and exciting microplasma devices.

BACKGROUND

Microplasma arrays have a number of applications, most notably in displays, biomedical diagnostics and environmental sensing. In these devices, an electric field is generated in cavities of small dimension (typically, 500 μm or less) by exciting electrodes adjacent to or within the cavity with a DC, radio-frequency, AC or pulsed voltage. If the peak field strength generated in the cavities exceeds a threshold value, a microplasma discharge is ignited in a discharge gas or vapor that fills the cavities. This discharge emits light at one or more wavelengths.

Regardless of the application envisioned for microplasma arrays, the success of these arrays relative to other, competing technologies will depend on minimizing manufacturing cost as the arrays are scaled up in emitting surface area, radiant power output, and array lifetime. Therefore, a method and structure that simplifies the fabrication of large (>several $cm^2$) arrays of microplasma devices is highly desirable.

SUMMARY OF THE INVENTION

In a first embodiment of the invention, a method is provided for manufacturing an array of microplasma devices. The method includes forming a plurality of electrodes on a first substrate, and forming a plurality of cavities in a second substrate. The second substrate is placed on, or sealed onto, the first substrate having the electrodes. The electrodes are configured to excite a microplasma discharge in the gas or vapor in each cavity. In specific embodiments of the invention, a dielectric layer is formed on the electrodes and the electrodes may excite microplasma discharges in the cavities without making physical contact with any of the cavities in the array or the gas or vapor within each cavity. In other embodiments of the invention, the cavities may be filled with a discharge gas and the second substrate is covered so that each cavity is sealed. In specific embodiments of the invention, an additional protective layer is formed on the dielectric layer.

In further specific embodiments of the invention, the cavities may be formed into an array and the electrodes may be formed into an interdigitated array. The spacing and width of the electrode fingers may be set such that at least two electrode fingers lie under each cavity. In this fashion, the registration of the second substrate with respect to the electrode array is not critical and manufacturing cost may be reduced.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

In certain embodiments of the present invention, a method is provided for fabricating arrays of microplasma discharge devices. The method draws from techniques that are used in the fabrication of semiconductor devices, such as integrated circuits, and microelectromechanical ("MEMS") systems. A first substrate, such as a silicon or glass wafer, is provided and electrodes are formed on the substrate, such as by metal deposition. A dielectric layer is deposited on the electrodes and a non-conducting protective layer may be deposited on the dielectric layer. A second substrate, which may be cut from a photosensitive glass such as Foturan™ or other similar material, is provided and microdischarge cavities (microcavities) are formed in the substrate by laser micromachining or photolithography and chemical etching or other techniques known to those skilled in the art. The second substrate is then bonded onto the layered structure that includes the first substrate. The cavities may be filled with a gaseous discharge medium which may include one gas, two or more gases, a gas and a vapor, or a gas and a metal-halide salt, the latter of which evolves into a vapor in the microcavity as the array is operated and heating occurs naturally. A gas-impermeable transparent cap may be bonded on top of the second substrate. A microplasma discharge is excited in a cavity of the device by electrical stimulation of the coplanar electrodes (i.e., applying a time-varying voltage to the electrodes if either or both the dielectric layer and protective layer are present, or an AC or DC voltage if they are not.) This method of fabricating such microplasma discharge arrays advantageously allows large arrays producing intense light emissions to be produced inexpensively. Additionally, the electrodes that excite the microplasmas are physically isolated from the microcavities and the discharges within them. This arrangement may advantageously extend electrode lifetimes significantly because the discharges do not erode the electrodes by ion bombardment or sputtering, as in conventional devices.

Figure 1:
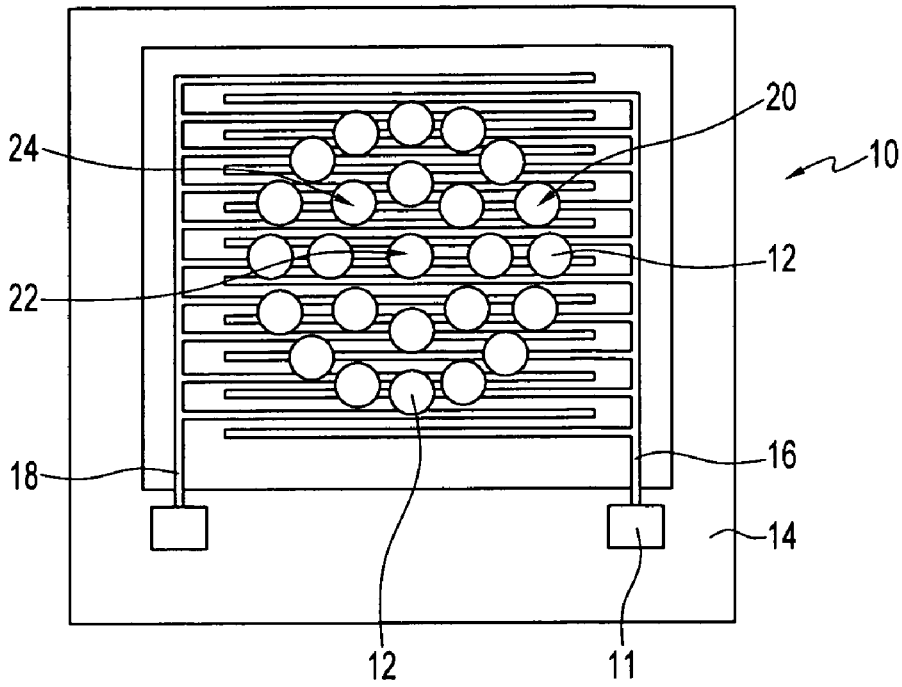
FIG. 1 shows a schematic top view of a microplasma array device according to an embodiment of the present invention.
Figure 2:
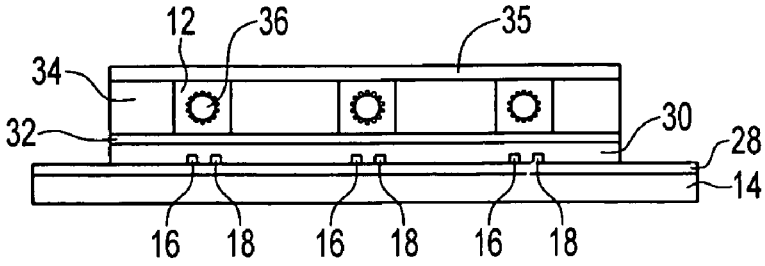
FIG. 2 shows a schematic cross-section of the FIG. 1 device.

A microdischarge array 10 comprising a plurality of microdischarge cavities 12, fabricated according to an embodiment of the invention, is shown in FIGS. 1 and 2. In the view of FIG. 1, the primary light emission direction is out of the plane of the figure although a portion of the emission is directed in the plane of the second substrate. Also, the light directed into the plane of FIG. 1 can either be reflected with a reflective coating atop the protective layer, or transmitted through a transparent substrate onto which electrodes formed from indium tin oxide are patterned. Indium tin oxide is transparent in the visible, thereby allowing visible light to be transmitted through the electrode array. In the side view shown in FIG. 2, the primary light emission direction is toward the top of the figure. Each cavity 12 in this embodiment is cylindrical, but the cavities are not limited to cylinders and may be formed in any geometric shape. Also, the microcavities can be arranged in virtually any pattern and not just the Fresnel pattern of FIG. 1.

A first substrate 14 is provided which may be a silicon wafer. This substrate might also be selected from the Group III-V semiconductor materials. In still other embodiments, the substrate may be plastic, glass, ceramic, or another solid material onto which the remaining structure may be formed. An insulating layer 28, e.g., silicon dioxide, silicon nitride, or another dielectric, is formed on the first substrate. (Note that layer 28 can improve the dielectric properties of the first substrate.) Electrodes 16, 18 are formed on the insulating layer 28 by, for example, thin film metal deposition. Any of a variety of deposition techniques (e.g., sputtering, evaporation, chemical vapor deposition, electroplating, etc.) may be used to produce the electrodes which are not necessarily metal films. Other conducting materials (semiconductors, organics, etc.) are also acceptable. A dielectric layer 30 is formed on the electrodes preventing electrical breakdown between the electrodes and physically isolating the electrodes 16, 18 from the microdischarge. The dielectric layer 30 may be chosen from a variety of well-known materials such as polyimide, silicon nitride, or silicon dioxide. A protective layer 32 comprising a robust dielectric such as magnesium oxide may be deposited onto the dielectric layer 30. Also, for discharges in non-corrosive gases or in situations in which array lifetime is not of primary concern, it may be possible to dispense with layer 32 and/or 30. As used in this description and in any appended claims, "layers" may be formed in a single step or in multiple steps (e.g., depositions) and one layer or structure may be formed or layered on another structure or layer without being directly adjacent to or in contact with the other structure or layer. Also note that, although electrodes 16, 18 are only shown in FIG. 2 immediately below each microcavity, the electrodes are equally spaced on the surface of the insulating layer 28 and some might lie under portions of a second substrate 34 in which a micro-cavity does not exist, as described below.

As shown in FIG. 2, an array 10 of microdischarge cavities 12 is formed in a second substrate 34, which can be, for example, a photodefinable glass such as Forturan™. The cavities are formed by laser micromachining or chemical etching or other techniques as are known in the art. The second substrate 34 is bonded onto, or simply rests on, protective layer 32. The cavities may be filled with a discharge gas, such as the atomic rare gases, $N_2$, and the rare gas-halogen donor gas mixtures (such as $Ne/Kr/F_2$ or Xe/HCl). Gas pressure and gas mixture composition may be chosen to optimize the number density of the desired radiating species. The interdigitated electrodes 16, 18 form electrode pairs that provide excitation to create a time-varying electromagnetic field in the discharge cavities 12. The voltage waveform driving the electrodes may be AC, RF, microwave or pulsed (bipolar, unipolar, etc.) If layers 30 and 32 are absent, the microdischarges can be excited DC. Layers 30 and 32 are thin, preferably a few microns, as at least the peak electric field strength generated in the microdischarge cavities must be sufficient to produce a plasma discharge in the gas(es) within the cavities. Thicker layers reduce the electric field strength in the microcavity, thereby making it more difficult to produce discharges in the microcavities. The peak electric field strength in each cavity may be tailored by selection of the material for the dielectric layers (as well as their thicknesses), the width and spacing of the electrodes, and the dimensions and geometry of the cavities, as is known in the art. While the electrodes shown in FIG. 1 are in the form of an exemplary interdigitated array, other arrangements of electrodes (such as alternating concentric circles) are possible to create the required peak electric field strength in the cavities, as will be apparent to those skilled in the art. Though not illustrated in FIG. 1, the electrodes 16, 18 may be connected to control circuitry through electrical contact pads 11, and the array itself may form part of an integrated circuit. Cavities can be cylindrical in cross section and situated above an electrode array. Cavities can have other geometries. For example, cavities 75 can be approximately square or rectangular in cross section, and situated above an electrode array.

A window 35 (FIG. 2) fabricated from a material transparent in the desired spectral regions (visible, ultraviolet, infrared, or some portion of two or more regions) such as glass, quartz, or sapphire in the visible, near-infrared and ultraviolet, or ZnSe, KBr, etc. in the infrared, may be bonded or otherwise sealed to the substrate 34. The window 35, fabricated from a substance transparent to the wavelength(s) of interest, seals the discharge medium 36—a vapor or gas—in the microdischarge cavities 12.

In the embodiment of FIG. 1, a central microcavity (pixel) 22 and rings 20 and 24 of microdischarges are excited by an electromagnetic field created by the electrodes when a time-varying electric potential is applied to the electrodes 16, 18. However, the electrodes of FIGS. 1 and 2 may be rearranged (or a dielectric film may be deposited selectively on a portion of one electrode array) so as to allow the electrical connection to the second sub-array to cross that for the first sub-array without an electrical short occurring so that only the outermost ring 20 or the innermost pixel 22 or the middle ring 24 (or combinations thereof) are excited. In this manner, the rings 20-24 may be separately controlled. In other embodiments of the invention, more rings of microcavities may be used and individually controlled by, for example, two or more sets of electrodes. Alternatively, the microcavities may be arranged in a rectangular pattern, comprising lines and rows of microcavities. In the manner described above—using dielectric to isolate electrical connections—individual lines or rows of microcavities may be excited. Also, as noted earlier, the microcavities need not be laid out in rings. The arrangement of microcavities is not constrained to a particular pattern.

The lower size limit of the diameter of the microdischarge cavities 12 in which the microdischarges are generated is determined by several factors, one of which is the microfabrication technique used to form the microdischarge cavities. Although the microdischarge cavities (for the prototype arrays produced to date) are cylindrical or rectangular in cross-section and have characteristic dimensions of 75 or 100 μm, fabricating microplasma devices of much smaller (<10 μm) or larger sizes may be accomplished with well known microfabrication techniques. As indicated above, the cross-section of the individual microdischarge cavities need not be circular, but may assume any desired shape. While the substrate in which the microdischarge cavities are formed has been described above as Forturan™, a photodefinable glass, a wide variety of materials may be used for this substrate depending on the application. For example, sapphire, quartz, glass epoxy, other types of glasses, or various bulk dielectrics may be used in other embodiments of the invention.

In specific embodiments of the invention, the interdigitated electrodes are fabricated such that the pitch (center-to-center spacing of adjacent electrodes) of the interdigitated electrode array is less than the diameter of each microplasma cavity. This arrangement is particularly advantageous since it simplifies significantly the assembly of the structure because the need to precisely align the electrode array with the microcavity array is eliminated. Alignment of these two arrays is potentially an issue since the microcavity array and the electrode array (including the first substrate, the first dielectric, and the protective and second dielectric layers) may be fabricated separately but must then be joined in such a way that two adjacent electrodes in the interdigitated array lie immediately below each microcavity in the array. If the spacing between adjacent electrodes, and the width of the electrodes are chosen properly (i.e., to match the electrode "load" to the AC, RF, or pulsed source driving it, as well as to allow one "cycle" of the interdigitated array to be less than the diameter of each microplasma discharge cavity), then the process of joining the two pieces of the assembly is not critical and each microplasma discharge cavity will have at least one pair of electrodes beneath it. For example, if microcavities have a diameter of approximately 100 μm and the pitch and width of the electrodes in the interdigitated array are both 20 μm, then behind each microcavity will be at least two electrodes.

Figure 3:
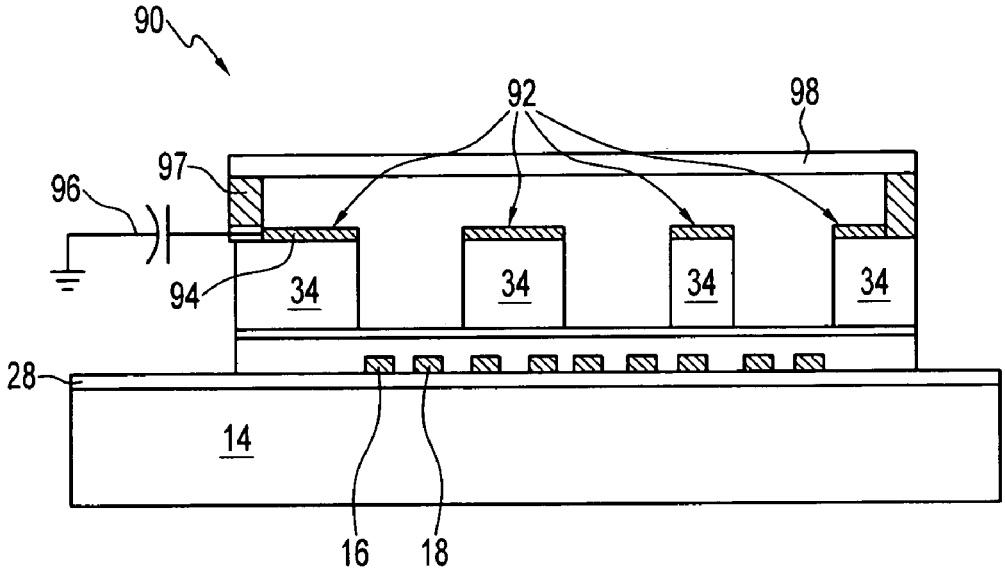
FIG. 3 is a cross-sectional diagram of another embodiment of the present invention.

In another embodiment of the invention, shown schematically in FIG. 3, a device structure 90 is provided that is similar to the device shown in FIG. 2. However, an electrode layer 92 (a "third electrode") is deposited onto the face 94 of the second substrate 34 that is away from the electrode array (16, 18). Electrical connection is made to this electrode layer 92 and is either grounded directly or connected to ground through a capacitor 96 (for AC operation). The capacitor 96 may be a discrete component or distributed in the form of another dielectric layer on top of the third electrode 92, followed by another electrode which is grounded. The presence of the third electrode 92 is to shape the electric field in the microcavities as well as to drain charge that might otherwise build up on the surface of the second substrate. An additional function (if desired) of the third electrode is to serve as a gate by which electrons can be extracted from the microdischarges during both half-cycles of the AC voltage waveform. Electrons extracted from the microdischarges proceed out of the microcavities and may strike a phosphor screen 98, mounted on a spacer 97, if provided, thereby making the structure of FIG. 5 suitable for lighting or for use as a display.

Other embodiments of the invention dispense with the dielectric layer and the protective layers entirely and allow the second substrate (with cavities) to be overlaid on the electrode array directly.

Microplasma discharge devices and arrays according to the present invention have been described above that include interdigitated electrode arrays. In other embodiments of the invention, other arrangements of electrodes may be used to generate an electric field with sufficient peak strength to ignite the microplasma discharges within the cavities, as will be apparent to those skilled in the art. Similarly, it is of course apparent that the present invention is not limited to the other aspects of the detailed description set forth above. Various changes and modifications of this invention as described will be apparent to those skilled in the art without departing from the spirit and scope of this invention as defined in the appended claims.

What is claimed is:

1. A device comprising:

a first substrate;

a plurality of electrodes formed on the first substrate;

a second substrate including a plurality of cavities, the second substrate situated above the electrodes, such that the electrodes are configured to excite a microplasma discharge in each cavity; wherein the electrodes are interdigitated;

wherein each of the cavities is characterized by having no dimension larger than 100 μm in any direction perpendicular to an axis of symmetry of each of the cavities; and the width and spacing is such that at least two electrodes lie substantially underneath each cavity.

2. A device according to claim 1, further comprising a dielectric layer formed on the electrodes.

3. A device according to claim 2 further including a protective layer formed on the dielectric layer.

4. A device according to claim 2 wherein the electrodes are configured such that the electrodes are not in direct physical contact with any cavity.

5. A device according to claim 1 wherein each cavity is filled with a gas and the second substrate is encapsulated such that the gas fill is maintained within each cavity.

6. A device according to claim 5 wherein a window that is transparent in a desired spectral region is bonded to the second substrate, and the second substrate is bonded to the first substrate.

7. A device according to claim 1 wherein the electrodes are configured to excite discharges in a first subset of the cavities while a second subset of the cavities is not excited and to excite discharges in the second subset while the first subset is not excited.

8. A device according to claim 1 further including a dielectric layer formed on the electrodes such that the electrodes are not in direct physical contact with any cavity.

9. A device according to claim 1, wherein the second substrate is characterized by a face proximate to the electrodes and a face distal to the electrodes, further including a drain electrode, the electrode situated on the distal face of the second substrate.

10. A device according to claim 1, wherein the cavities have a cylindrical or rectangular cross-section.

11. A device comprising:

a first substrate;

a plurality of electrodes formed on the first substrate; and a second substrate including a plurality of cavities, each of the cavities being characterized by having no dimension larger than 100 μm in any direction perpendicular to an axis of symmetry of each of the cavities, the second substrate situated above the electrodes, such that the electrodes are configured to excite a microplasma discharge in each cavity.

12. A device according to claim 11, wherein the cavities have a rectangular or circular cross-section.

13. A device comprising:

a first substrate;

a plurality of electrodes formed on the first substrate;

a second substrate including a plurality of cavities, the second substrate situated above the electrodes, such that the electrodes are configured to excite a microplasma discharge in each cavity; wherein the electrodes are interdigitated;

wherein the cavities each have a diameter of 100 μm or less; and the width and spacing is such that at least two electrodes lie substantially underneath each cavity, wherein the spacing between adjacent ones of the electrodes is less than the diameter of each of the cavities.

14. A device according to claim 11, wherein the spacing between adjacent ones of the electrodes is less than the diameter of each of the cavities.

* * * * *

UNITED STATES PATENT AND TRADEMARK OFFICE

CERTIFICATE OF CORRECTION

PATENT NO. : 7,511,426 B2
APPLICATION NO. : 10/984022
DATED : March 31, 2009
INVENTOR(S) : Eden et al.

It is certified that error appears in the above-identified patent and that said Letters Patent is hereby corrected as shown below:

On the Title Page:

| | |
|---|---|
| Item (54) Title: | Please delete the title, "MICROPLASMA DEVICES EXCITED BY INTERDIGITATED ELECTRODES" and insert --MICROPLASMA DEVICES HAVING FIRST AND SECOND SUBSTRATES-- in its place. |
| Col. 5. line 41 | Please delete "FIG. 5" and insert --FIG. 3-- in its place. |

Signed and Sealed this

Twenty-eighth Day of July, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,511,426 B2
APPLICATION NO. : 10/984022
DATED : March 31, 2009
INVENTOR(S) : Eden et al.

It is certified that error appears in the above-identified patent and that said Letters Patent is hereby corrected as shown below:

On the Title Page, Item (54) and Column 1, lines 1 and 2:

| | |
|---|---|
| Title: | Please delete the title, "MICROPLASMA DEVICES EXCITED BY INTERDIGITATED ELECTRODES" and insert --MICROPLASMA DEVICES HAVING FIRST AND SECOND SUBSTRATES-- in its place. |
| Col. 5. line 41 | Please delete "FIG. 5" and insert --FIG. 3-- in its place. |

This certificate supersedes the Certificate of Correction issued July 28, 2009.

Signed and Sealed this

Eighteenth Day of August, 2009

David J. Kappos

David J. Kappos
*Director of the United States Patent and Trademark Office*